US010114341B2

(12) United States Patent
Conus et al.

(10) Patent No.: US 10,114,341 B2
(45) Date of Patent: Oct. 30, 2018

(54) INERTIA SETTING OR POISING OF A TIMEPIECE SPRUNG BALANCE ASSEMBLY

(71) Applicant: Nivarox-FAR S.A., Le Locle (CH)

(72) Inventors: Thierry Conus, Lengnau (CH); Marco Verardo, Les Bois (CH); Christian Charbon, Chezard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 531 days.

(21) Appl. No.: 14/441,062

(22) PCT Filed: Oct. 22, 2013

(86) PCT No.: PCT/EP2013/072011

§ 371 (c)(1),
(2) Date: May 6, 2015

(87) PCT Pub. No.: WO2014/072168

PCT Pub. Date: May 15, 2014

(65) Prior Publication Data

US 2015/0268632 A1 Sep. 24, 2015

(30) Foreign Application Priority Data

Nov. 6, 2012 (EP) ..... 12191481

(51) Int. Cl.
*G04D 7/08* (2006.01)
*G04B 17/06* (2006.01)

(52) U.S. Cl.
CPC ..... *G04D 7/087* (2013.01); *G04B 17/06* (2013.01); *Y10T 29/49581* (2015.01)

(58) Field of Classification Search
CPC ..... G04D 7/087; G04D 7/004; G04B 17/06; G04B 1/145; Y10T 29/49851; G04G 9/0076
See application file for complete search history.

(56) References Cited

U.S. PATENT DOCUMENTS 9,436,162 B2 * 9/2016 Klinger ..... G04D 7/004
2002/0191493 A1 * 12/2002 Hara ..... G04G 9/0076 368/47

(Continued)

FOREIGN PATENT DOCUMENTS

CH 532 284 7/1972
CH 704 211 6/2012

(Continued)

OTHER PUBLICATIONS

International Search Report dated Mar. 6, 2014 in PCT/EP13/072011 Filed Oct. 22, 2013.

*Primary Examiner* — Jacob Cigna
*Assistant Examiner* — Lee A Holly
(74) *Attorney, Agent, or Firm* — Oblon, McClelland, Maier & Neustadt, L.L.P.

(57) ABSTRACT

A method of setting inertia of and/or poizing a timepiece sprung balance assembly including: manufacturing a balance and a balance spring irreversibly assembled to each other; fixing an outer coil of the balance spring in position in a tamperproof manner to a balance spring stud which is immobilized in a tamperproof manner by irreversible attachment to a balance cock; determining a peripheral surface of the balance, every point of which is remote from the balance spring by a first predefined distance; performing a remachining operation only on the peripheral area.

15 Claims, 2 Drawing Sheets

(56) References Cited

U.S. PATENT DOCUMENTS

| | | | | |
|---|---|---|---|---|
| 2010/0157743 | A1 | 6/2010 | Silva | |
| 2010/0290320 | A1 * | 11/2010 | Gygax | G04B 1/145 368/177 |

FOREIGN PATENT DOCUMENTS

| | | | | |
|---|---|---|---|---|
| EP | 2 315 082 | | 4/2011 | |
| FR | 2 179 744 | | 11/1973 | |
| WO | WO 2012007460 | A1 * | 1/2012 | G04D 7/004 |

* cited by examiner

INERTIA SETTING OR POISING OF A TIMEPIECE SPRUNG BALANCE ASSEMBLY

CROSS-REFERENCE TO RELATED APPLICATIONS

This is a National Phase Application in the United States of International patent application PCT/EP2013/072011 filed Oct. 22, 2013 which claims priority on European patent application No. 12191481.6 filed Nov. 6, 2012. The entire disclosures of the above patent applications are hereby incorporated by reference.

FIELD OF THE INVENTION

The invention concerns a method for producing and for setting the inertia of and/or for poising a sprung balance assembly mounted in a timepiece oscillator mechanism which includes, mounted on a plate carrying a balance spring stud via a balance cock, said sprung balance assembly including a balance pivoting about a pivot axis and a balance spring whose inner coil is fixed to said balance or to a collet mounted integrally with said balance and whose outer coil is fixed to said stud to be held to said balance cock.

The invention concerns the field of timepiece oscillator mechanisms with a sprung balance.

BACKGROUND OF THE INVENTION

It is always difficult to operate on an assembled sprung balance assembly to adjust the oscillation frequency of a sprung balance, because of the risks of modifying the balance spring. The operation is even more difficult when envisaged in a timepiece movement that is already assembled, because of constraints for the protection of other components, and the cleanliness of the movement.

FR Patent No 2179744 A1 in the name of Far discloses a method of poising and adjusting the oscillation frequency of a sprung balance, by removing material from the balance felloe using a cutting tool, in correlation with measuring and drive means, without any particular protection of the balance spring.

CH Patent No 532284 A in the name of Suwa Seikosha KK discloses a rotor poising device, and re-machining of the balance, with the balance spring secured to the collet. This re-machining is performed with a drill, which requires stopping and holding the balance to carry out the machining operation.

CH Patent No 704211 A2 in the name of Swatch Group R&D concerns the protection of the balance spring against electromagnetic radiation, and this document indicates a rule of proportion between the diameter of the balance and the diameter of the outer coil of the balance spring, with no mention of the terminal curve or the attachment to the balance spring stud, or any contact with an index.

US Patent No 2012/157743 A1 in the name of Silva Regio-Roger Dubuis SA discloses the assembly of a balance spring taken from a series of springs, on a balance via a collet affixed to the balance, said collet being selected from among a set of collets which have points of attachment to the balance spring that may be closer or farther from the staff.

EP Patent No 2315082 A2 in the name of Audemars Piguet & Co discloses a regulating member including two coaxial balances.

SUMMARY OF THE INVENTION

The invention proposes to ensure the security of the balance spring of a sprung balance assembly, during poising or setting of the inertia of the balance when the balance spring and balance have already been assembled to each other, and in particular when the sprung balance assembly is already mounted in the timepiece movement.

The difficulty consists in preventing any modification of the balance spring during re-machining of the balance.

To this end, the invention concerns a method for producing and for setting the inertia and/or for poising a sprung balance assembly mounted in a timepiece oscillator mechanism which includes, mounted on a plate carrying a balance spring stud via a balance cock, said sprung balance assembly including a balance pivoting about a pivot axis and a balance spring whose inner coil is fixed to said balance or to a collet mounted integrally with said balance and whose outer coil is fixed to said stud to be held to said balance cock, characterized in that:

- said balance and said balance spring are manufactured and irreversibly assembled to each other by fixing said inner coil to said balance or to said collet mounted integrally with said balance;
- said outer coil is fixed in position in a tamperproof manner to said balance spring stud which is immobilised in a tamperproof manner by irreversible attachment with respect to said balance cock;
- there is selected a re-machining technology for setting the inertia of and/or for poising said balance by the removal of material, from among tool or abrasive machining or laser beam or plasma projection or liquid jet projection, said re-machining technology being implemented by a re-machining means including a means of ablation and/or of charging and/or of deformation and/or of heat treatment;
- there is defined, according to the selection of said re-machining technology, the value of a first distance, forming the minimum distance between any point of said balance spring and a re-machining area for setting the inertia of and/or for poising said balance;
- there is determined a peripheral surface for setting the inertia of and/or for poising said balance, at the periphery of said balance, as said re-machining area, any point of said surface being separated from said balance spring by at least the value of said first predefined distance, to prevent any modification of the features of said balance spring during the irreversible re-machining of said balance on said peripheral area for setting the inertia of and/or for poising said balance on said assembled sprung-balance assembly;
- the balance spring is made, prior to attachment to the balance, with the outer coil thereof bent and/or twisted at the attachment thereof to the balance spring stud so as to move an active end portion of the outer coil away from the peripheral surface;
- the balance and the balance spring are manufactured and irreversibly assembled to each other by fixing the inner coil to the balance or to the collet mounted integrally with the balance;
- the outer coil is fixed in position in a tamperproof manner to the balance spring stud which is immobilised in a tamperproof manner by irreversible attachment with respect to the balance cock;
- there is defined, according to the choice of said re-machining technology, the value of a second distance, greater than or equal to said first distance and forming the minimum distance between said balance spring stud and said peripheral surface separated from said balance spring stud by a value greater than a second predefined distance, to prevent any modification of the features of the attachment of said balance spring to said balance spring stud during re-machining of said balance on said peripheral area for setting the inertia of and/or for poising said balance on said assembled sprung-balance assembly;

there are determined the value and location of any necessary re-machining operations for setting the inertia and/or for poising;

the inertia setting and/or poising re-machining operations are performed only on said peripheral surface, while limiting the trajectory of said re-machining means to a volume external to a first surface of revolution about said pivot axis and resting on the minimum radius of said peripheral surface and at a distance greater than said first distance from any active point of said balance spring, said first surface being a first cone apex centred on said pivot axis and whose first apex angle is lower than a first predetermined value.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
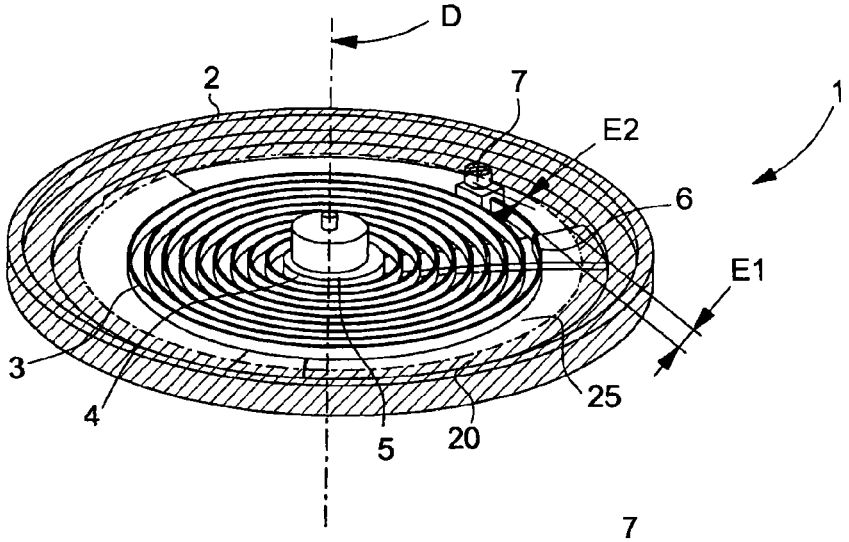
FIG. 1 shows a schematic, perspective view of a sprung balance assembly according to the invention.

A distinction will be made here between:

the sprung balance pair wherein the balance and the balance spring are irreversibly fixed to each other;

and the top assembly which is a regulating member including both this sprung balance pair and any adjusting screws.

The invention therefore concerns a timepiece oscillator mechanism 10, intended to be incorporated in timepiece movement 100, and including, mounted on a plate 8 carrying a balance spring stud 7 via a balance cock 80, at least one timepiece sprung balance assembly including a balance 2 pivoting about a pivot axis D and a balance spring 3. An inner coil 4 of this balance spring 3 is fixed to balance 2 or to a collet 5 mounted integrally with the balance 2, and an outer coil 6 of this balance spring 3 is fixed to balance spring stud 7 to be held on plate 8 or on balance cock 80. The invention is described here in the particular case of a regulating member with a single balance and a single balance spring, those skilled in the art will know how to extrapolate the invention to the case of several balances and/or several balance springs.

According to the invention, as seen in FIG. 1, the balance 2 includes a machinable peripheral surface 20, which is separated from any point of balance spring 3 by a value greater than a first predefined distance E1, to prevent any modification of the features of the balance spring 3 during the irreversible re-machining of the balance 2 on the peripheral machinable surface 20 to set the inertia of and/or to poise the balance 2 on the assembled assembly 1.

"Re-machining" means here any operation capable of locally modifying the inertia of the balance: adding material, moving material, removing material. This operation may be performed, in a non-restrictive manner, by re-machining with a cutting or abrasion tool (drilling, turning, rectification or similar), by laser, in particular a picolaser or a femtolaser, by jet projection of material, by deformation using a tool, by localised fusion, by a heat treatment modifying the structure of the material, or other means.

In a particular implementation of the invention, any area 25 of balance 2 located beyond machinable peripheral surface 20 is made with at least the surface thereof including a heat treatment and/or a surface treatment conferring higher than normal resistance to machining by a tool or by abrasion or by laser, and/or is made of a material resistant to machining by tools or by abrasion or laser.

Although the first distance E1 may be, in the most general case, in any position of balance spring 3, particular distance values may be set for each of certain specific positions of the balance spring: at rest, at the maximum positive oscillation amplitude, at the maximum negative oscillation amplitude, or another position.

Thus, it is a question of protecting the balance spring, in order to carry out appropriate modifications to balance 2, without in any way modifying the features of balance spring 3, and in particular without directly or indirectly subjecting it to a thermal influence, or to projections of chips or of material, or other influences, capable of modifying the torque and thus the oscillation frequency of said balance spring.

In particular, peripheral surface 20 is separated from the most off-centre point radially from the active part (that is to say subject to oscillation) of the outer coil 6 of balance spring 3 by a value greater than first distance E1.

Preferably, the first predefined distance E1 is greater than 0.50 mm. Advantageously, according to the invention, the first predefined distance E1 is comprised between 0.50 mm and 1.20 mm. In a particular application, the first predefined distance E1 is comprised between 0.50 mm and 0.70 mm.

Figure 2:
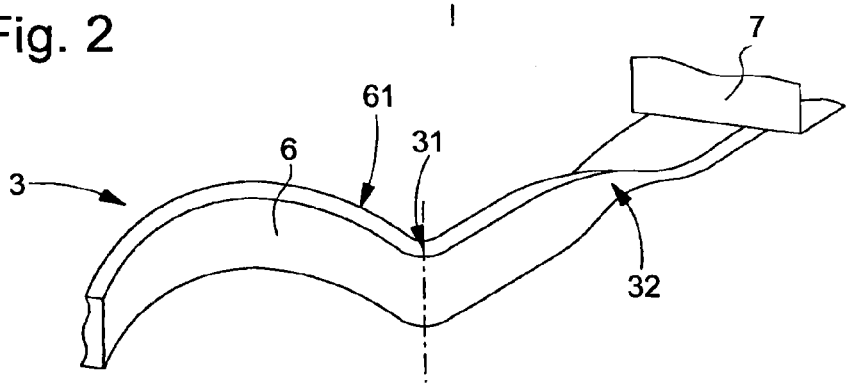
FIG. 2 shows a schematic, perspective view of the outer end of a balance spring in a preferred variant of the invention.

In a particular application illustrated in FIG. 2, balance spring 3 is bent into a bend 31 and/or twisted in a twisting area 32, on or in proximity to the attachment thereof to the balance spring stud 7 so as to move the active part 61 of outer coil 6 of balance spring 3 away from peripheral surface 20. This active part 61 of balance spring 3 is thus separated from the peripheral re-machining surface 20 of balance 2, and preferably by a distance greater than ⅔ of the radial span of peripheral surface 20, which is annular in projection into a plane perpendicular to pivot axis D.

Preferably, according to the invention, peripheral surface 20 is separated from balance spring stud 7 by a value greater than a second predefined distance E2, to prevent any modification of the features of balance spring 3 during re-machining of balance 2 on peripheral area 20 for poising and/or setting the inertia of balance 2 on the assembled assembly 1; and, in particular to prevent modifying any features by indirectly heating balance spring 3. Preferably, the second predefined distance E2 is greater than 0.05 mm. This second predefined distance E2 is preferably comprised between 0.05 mm and 0.20 mm. In a particular application, the second predefined distance E2 is comprised between 0.05 mm and 0.10 mm.

Although the second distance E2 may be, in the most general case, in any position of balance spring 3, particular distance values may be set for each of certain specific positions of the balance spring: at rest, at the maximum positive oscillation amplitude, at the maximum negative oscillation amplitude, or another position.

In order to perform the re-machining of balance 2 for setting the inertia and/or for poising, according to the invention, peripheral surface 20 is accessible, from at least one side of balance 2, to a means of ablation and/or recharging and/or deformation and/or projection and/or heat treatment in a volume external to a first surface 21. This first surface 21 is a surface of revolution about pivot axis D, and rests on the minimum radius 201 of peripheral surface 20. First surface 21 is also at a distance greater than a third distance E3 from any active point of balance spring 3 to prevent any modification of the features of balance spring 3 during the re-machining of balance 2 on peripheral surface 20 for setting the inertia and/or for poising balance 2.

Figure 3:
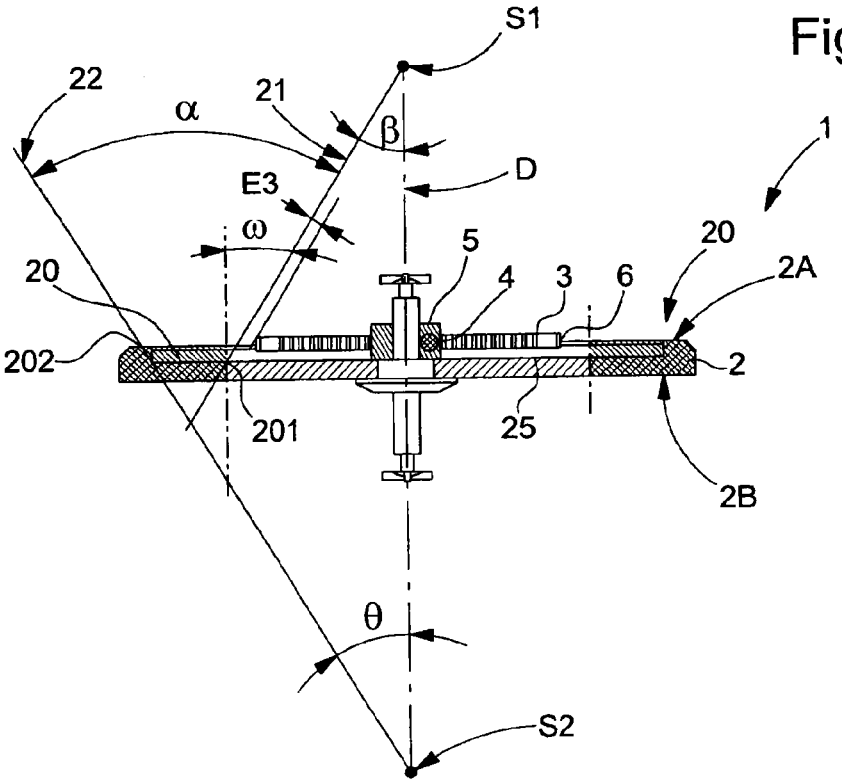
FIG. 3 shows a schematic cross-section of the sprung balance assembly of FIG. 1 through the pivot axis.

In a particular implementation of the invention, as shown in FIG. 3, the first surface 21 is a cone whose apex S1 is on the same side as balance spring 3 relative to balance 2.

The Figures illustrate a simplified case of re-setting the inertia of balance 2 on a single side, called the upper side 2A. Naturally, it is entirely possible to envisage performing inertia re-setting machining on the opposite, lower side 2B. In such case, the first surface 21 is formed of two semi-surfaces, one on each side of the rim of balance 2, for example with two cone portions having opposite openings.

In a particular embodiment, to take account not only of the protection of balance spring 3, but also the rest of the timepiece movement, in the case where the re-poising and/or re-setting of the inertia of balance 2 is performed directly inside the movement 100 comprising oscillator mechanism 10, which in turn includes balance 2 and balance spring 3, the volume of access to the inertia modifying means of balance 2 towards peripheral surface 20 is limited, not only on the side of balance spring 3 by first surface 21, but also, on the external side, by a second surface 22. In such case, the peripheral surface 20 is accessible, from at least one side of balance 2, to a means of ablation and/or of charging in a volume delimited by two surfaces coaxial to pivot axis D, a first surface 21 resting on the minimum radius 201 of peripheral surface 20 and at a distance greater than a third distance E3 from any active point of balance spring 3 to prevent any modification of the features of balance spring 3 during re-machining of balance 2 on peripheral surface 20 for setting the moment or inertia of and/or for poising balance 2, and a second surface 22 resting on another radius 202 of the peripheral surface 20 greater than minimum radius 201 and defining a protective envelope for the timepiece mechanism surrounding sprung balance assembly 1 during the re-machining of balance 2 on peripheral surface 20 to poise and/or set the inertia of balance 2 on assembled assembly 1.

The purpose of the limitation provided by this second surface 22 is to ensure the protection of balance spring 3 against any direct or indirect projection, by reflection or ricochet, of a chip or other waste, on a surface of the balance, or of a bridge or of a balance cock.

In the particular case of FIG. 3, the second surface 22 is a cone whose apex S2 is on the opposite side of balance spring 3 relative to balance 2.

Preferably, the first surface 21 and second surface 22 together define, in a cross-section through pivot axis D, a smaller angle $\alpha$ than a predetermined value $\alpha 0$ which is less than 45°.

The tangent to first surface 21 on peripheral surface 20, in the plane of pivot axis D, forms, with pivot axis D, in a cross-section through pivot axis D, a smaller angle $\beta$ than a predetermined value $\beta 0$, which is linked to the predefined value E3.

Likewise, the tangent to second surface 22 forms, with pivot axis D, in a cross-section through pivot axis D, a smaller angle e than a predetermined value e0. In a particular application, this angle e0 is 45°.

The value of third distance E3 is advantageously comprised between 100% and 120% of the value of first distance E1, and preferably the value of third distance E3 is equal to the value of first distance E1.

According to the invention, the sprung balance assembly 1 according to the invention is devised to be set in the factory for theoretical operation, and does not include any moving parts which could be inadvertently manoeuvred and create a significant chronometric error. In particular, balance spring 3 is tamperproof, i.e. sprung balance assembly 1 does not have an index assembly, or any element which could act on balance spring 3 or on balance spring stud 7 which is also tamperproof.

Balance 2 therefore includes an inertia adjustment means whose range of adjustment is minuscule, with very little adjustment power, for example a few seconds or a few tens of seconds per day. These means are for example formed by small screws which are held immobile in a re-machining position, which is either a fixed position determined for example by a notch, or which is a position of abutment on a bearing surface. These small screws are held in this fixed re-machining position for the entire duration of the inertia setting and/or poising re-machining operation. The reduced range of adjustment is only used in after-sales service. In this variant advantageously, balance 2 includes at least two housings 28, each arranged for receiving an adjustment screw captively mounted on either side of a peripheral section 29 of balance 2. This screw 9 is only moveable between a first stop position 91 on balance 2, on which a first head 93 of said screw 9 is held in abutment during a factory setting operation when the irreversible machining of balance 2 is performed, and a second stop position 92 defining an end of travel of a second head 94 of said screw 9. The distance PR between the first stop position 91 and the second stop position 92 limits the adjustment power of screw 9, which is preferably limited to 30 seconds per day for after-sales purposes.

Figure 4:
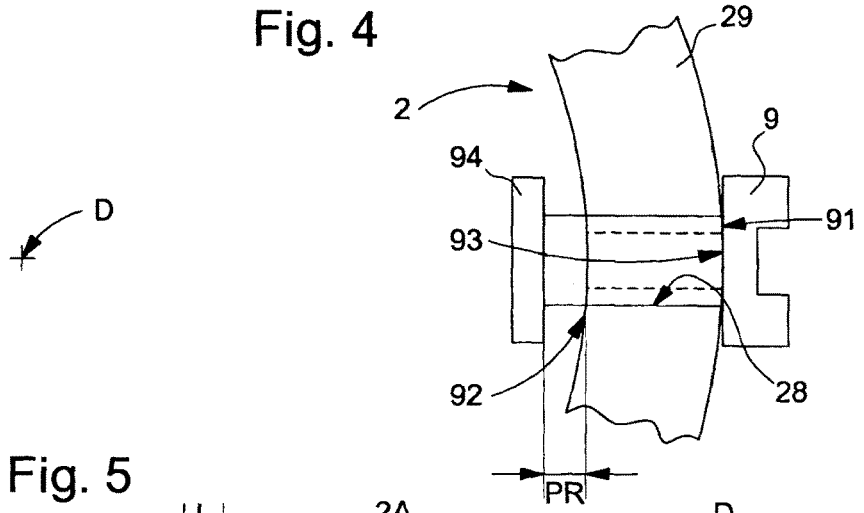
FIG. 4 shows a schematic top view of a detail of a single means of adjusting a balance particularly intended for after-sales service.
Figure 5:
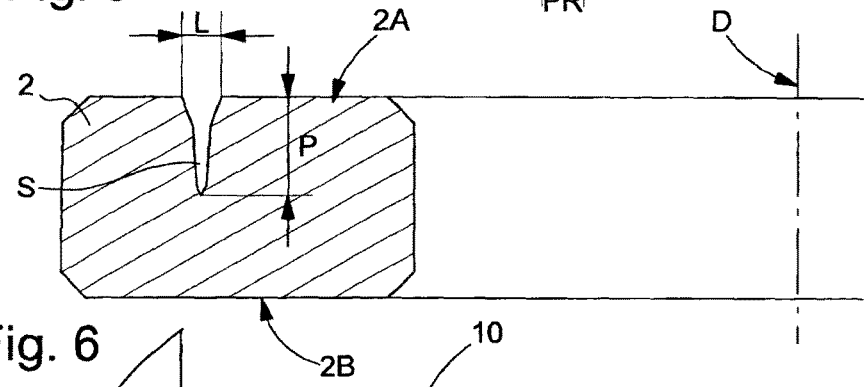
FIG. 5 shows a schematic cross-section through the pivot axis of a detail of a furrow made in the sprung balance assembly of FIG. 1.
Figure 6:
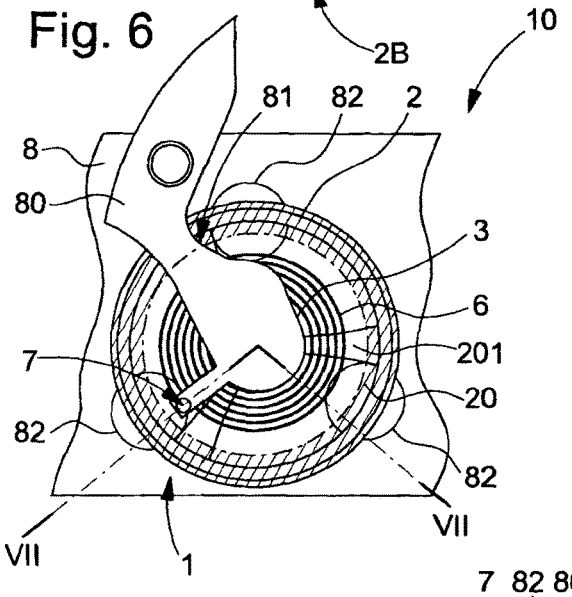
FIG. 6 is a schematic top view of the assembly of FIG. 1 mounted between a bridge and a balance cock which has a recess intended for channelling a suction flow in the alignment of an orifice in a plate.
Figure 8:
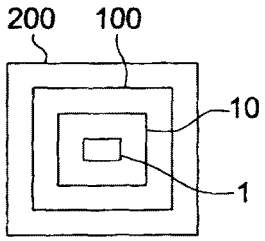
FIG. 8 is a block diagram showing a watch including a movement confining a sprung balance assembly of this type.
Figure 7:
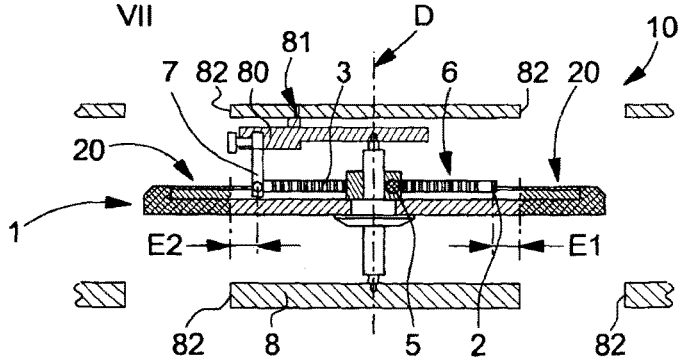
FIG. 7 is a local cross-section of FIG. 6.

In a particular embodiment, shown in FIG. 4, balance 2 therefore includes as the only means of adjustment, adjustment screws 9 which can only be moved between a first stop position 91 on balance 1 on which the screw heads 93 abut in the factory setting, and a second stop position 92 limiting their adjustment power to 30 seconds per day for the purposes of after-sales service. These adjustment screws 9 are the only elements that can be adjusted during use of sprung balance assembly 1, after the irreversible inertia setting and/or poising machining operation performed in the factory. It is clear that, when adjustment screws are present, the inertia setting and poising are necessarily performed with the adjustment screws in a stop position.

In another specific embodiment, balance 2 has strictly no adjustment means. Sprung balance 1 is then free of any index assembly or any means of adjustment during use.

In a preferred implementation of the invention, balance 2 is machined for inertia setting and/or poising the form of narrow furrows S, of depth P at least one times greater than their width L, and preferably at least three times greater than their width L.

In a particular implementation of this method, balance spring 3 may made of silicon, or silicon oxide, or single crystal diamond, or polycrystalline diamond, or glass, or metallic glass, or amorphous metal, or quartz, or a paramagnetic material, or ferromagnetic material, or an anti-ferromagnetic alloy.

In an advantageous variant, in addition to the safety distances defined by distances E1, E2, E3 described above, balance spring 3 is pre-heat treated to resist localised heating in a nearby area when balance 2 is re-machined on peripheral surface 20 to set the inertia of and/or poise balance 2.

The invention further concerns a timepiece oscillator mechanism 10 including at least one sprung balance assembly 1 with a balance spring 3, which is tamperproof and has no index assembly, mounted on a plate 8 carrying a balance spring stud 7 via a balance cock 80. According to the invention, balance cock 80 has an open shape and includes at least one recess 81 to facilitate the suction flow created in mechanism 10 when balance 2 is re-machined on peripheral surface 20 to set the inertia of and/or poise balance 2 on the assembled assembly 1. The suction would be ineffective if there were two surfaces of plate 8 and balance cock 80 facing each other on either side of balance 2.

Preferably, plate 8, or a balance cock 80 comprised therein in proximity to sprung balance assembly 1, includes at least one open hole 82 for facilitating a suction flow created in mechanism 10 when balance 2 is re-machined on peripheral surface 20 to set the inertia of and/or poise balance 2 in the assembled assembly 1.

In a particular variant, it is made impossible to machine the balance below a certain threshold diameter, for example by:

- a surface treatment or protection preventing the removal of material by a cutting tool or laser (for example a reflective surface protection in this latter case),
- or by constructing the balance in two, inner and outer parts, the inner part under this threshold diameter being formed of a material which precludes the removal of material by a cutting tool or laser.

The invention further concerns a timepiece movement 100 including an oscillator mechanism 10 of this type with a sprung balance assembly 1 having a tamperproof balance spring 3, a tamperproof balance spring stud 7, with no index assembly and with no other means of adjustment during use other than the aforementioned adjustment screws 9. In another variant, timepiece movement 100 includes an oscillator mechanism 10 of this type with a sprung balance assembly 1 having a tamperproof balance spring 3, a tamperproof balance spring stud 7, with no index assembly and with no other means of adjustment during use.

The invention also concerns a timepiece 200 including at least one such movement 100, and timepiece 200 is preferably a watch.

The invention concerns a method for producing and for setting the inertia of and/or for poising a sprung balance assembly 1 mounted in a timepiece oscillator mechanism 10 which includes, mounted on a plate 8 carrying a balance spring stud 7 via a balance cock 80, the sprung balance assembly 1 including a balance 2 pivoting about a pivot axis D and a balance spring 3 whose inner coil 4 is fixed to said balance 2 or to a collet 5 mounted integrally with balance 2 and whose outer coil 6 is fixed to stud 7 to be held to balance cock 80.

According to the invention:

- balance 2 and balance spring 3 are manufactured, and irreversibly assembled to each other by fixing inner coil 4 of balance spring 3 to balance 2 or to collet 5 mounted integrally with balance 2;
- outer coil 6 of balance spring 3 is fixed in position in a tamperproof manner to balance spring stud 7 which is immobilised in a tamperproof manner by irreversible attachment with respect to balance cock 80;
- there is selected a re-machining technology for setting the inertia of and/or for poising balance 2 by the removal of material, from among tool or abrasive machining or laser beam or plasma projection or liquid jet projection, the re-machining technology being implemented by a re-machining means including a means of ablation and/or of charging and/or of deformation and/or of heat treatment;
- there is defined, according to the selection of the re-machining technology, the value of a first distance E1, forming the minimum distance between any point of balance spring 3 and a re-machining area for setting the inertia of and/or for poising balance 2;
- there is determined a peripheral surface 20 for setting the inertia of and/or for poising balance 2, at the periphery of balance 2, as said re-machining area, any point of surface 20 being separated from balance spring 3 by at least the value of the first predefined distance E1, to prevent any modification of the features of balance spring 3 during the irreversible re-machining of balance 2 on peripheral area 20 for setting the inertia of and/or for poising balance 2 on the assembled sprung-balance assembly 1;
- there is defined, according to the selected re-machining technology, the value of a second distance E2, greater than or equal to first distance E1 and forming the minimum distance between balance spring stud 7 and peripheral surface 20 separated from balance spring stud 7 by a value greater than a second predefined distance E2, to prevent any modification of the features of the attachment of balance spring 3 to balance spring stud 7 during re-machining of balance 2 on peripheral area 20 for setting the inertia of and/or for poising balance 2 on the assembled sprung-balance assembly 1;
- there are determined the value and location of any necessary re-machining operations for setting the inertia and/or for poising;
- the inertia setting and/or poising re-machining operations are performed only on peripheral surface 20, while limiting the trajectory of the re-machining means to a volume external to a first surface of revolution 21 about pivot axis D and resting on the minimum radius 201 of peripheral surface 20 and at a distance greater than first distance E1 from any active point of balance spring 3, the first surface 21 being a cone with a first apex S centred on pivot axis D and whose first apex angle $\beta$ is lower than a first predetermined value $\beta 0$.

In a particular implementation of this method, when the inertia setting and/or poising re-machining is performed only on peripheral surface 20, the trajectory of the re-machining means is limited to an internal volume to a second surface 22 resting on the maximum radius 202 of peripheral surface 20 and defining a protective envelope for an oscillator mechanism 10 and a protective envelope for balance spring 3 against a direct or indirect projection of any chip or other waste, the second surface 22 being a cone with a second apex S2 centred on pivot axis D and whose second apex angle θ is lower than a predetermined second value θ0.

In a particular implementation of this method, the first apex S1 of the first surface 21 is on the same side as balance spring 3 relative to balance 2.

In a particular implementation of this method, the second apex S2 is on the opposite side to balance spring 3 relative to balance 2.

In a particular implementation of this method, first surface 21 and second surface 22 together define, in a cross-section through pivot axis D, a third angle α lower than a predetermined value α0 which is less than 45°.

In a particular implementation of this method, the second predetermined value θ0 is 45°.

In a particular implementation of the method, during the pre-manufacture of balance 2, any area 25 of balance 2 located beyond peripheral surface 20 and whose distance relative to pivot axis D is less than minimum radius 201 of peripheral surface 20 is made with at least the surface thereof including a heat treatment and/or a surface treatment conferring thereon greater resistance than the resistance of peripheral surface 20 to machining with a tool, or by abrasion, or by laser, and/or area 25 is made of a material more resistant than peripheral surface 20 to machining with a tool, or by abrasion, or by laser.

In a particular implementation of this method, at least one said area 25 is made with a surface cementation or nitriding treatment.

In a particular implementation of the method, at least one said area 25 is made with a surface metallizing treatment to render the surface reflective to laser beams in the usual wavelengths used for machining lasers.

In a particular application of this method, balance spring 3 is made, prior to attachment to balance 2, with the outer coil 6 thereof bent and/or twisted at the attachment thereof to balance spring stud 7 so as to move the active end part 61 of outer coil 6 away from peripheral surface 20.

In a particular implementation of the method, plate 8 and/or balance cock 80 are made to allow access of the re-machining means to peripheral surface 20.

In a particular implementation of this method, when the re-machining operation is performed to set the inertia of or to poise sprung balance assembly 1, balance 2 is machined with narrow furrows S having a depth P greater than one times the width L thereof.

In a particular implementation of this method, prior to being secured to balance 2, balance spring 3 is made from silicon, or silicon oxide, or single crystal diamond, or polycrystalline diamond, or glass, or metallic glass, or amorphous metal, or quartz, or a paramagnetic material, or ferromagnetic material, or an anti-ferromagnetic material.

In a particular implementation of this method:

- the position of the ends of balance spring 3 is set in a tamperproof manner with respect, on the one hand, to balance 2, and on the other hand, to a balance spring stud 7 which is immobilised in a tamperproof manner with respect to a plate 8 or to a balance cock 80 of a movement 10;
- any means 9 of adjusting the balance are immobilised in a re-machining position;
- the inertia setting and/or poising re-machining operation is performed.

In a particular implementation of this method, to perform the inertia setting or poising re-machining operation:

- there is placed, in proximity to sprung balance assembly 1, a means of machining by the removal of material, by tool or abrasive machining, or by projection of a laser beam or plasma or by liquid jet projection,
- outer coil 6 is secured in a tamperproof manner to balance stud 7 which is immobilised in a tamperproof manner by irreversible attachment relative to plate 8 or to balance cock 80 of movement 10;
- the value and location of the necessary inertia setting and/or poising re-machining operations are determined;
- the inertia setting and/or poising re-machining operation is carried out on peripheral surface 20.

In a particular implementation of this method:

- balance 2 is provided, at the initial manufacturing stage, with adjustment screws 9, captively mounted between two stop positions and, to perform the re-machining operations to set the inertia of or to poise the sprung balance assembly 1 in a factory setting position, each adjustment screw 9 of balance 2 is immobilised in a first stop position 91 on balance 2 in which a first head 93 comprised in screw 9 is held in abutment on a peripheral section 29 of balance 2.

In a particular implementation of this method, the first predefined distance E1 is selected with a value of between 0.50 mm and 1.20 mm.

More specifically, the first predefined distance E1 is selected with a value of between 0.50 mm and 0.70 mm.

In a particular implementation of this method, the second predefined distance E2 is selected with a value of between 0.05 mm and 0.20 mm.

More specifically, the second predefined distance E2 is selected with a value of between 0.05 mm and 0.10 mm.

In a particular implementation of the method, plate 9 and/or balance cock 80 is made such that peripheral surface 20 is accessible, from at least one side of balance 2, to a means of ablation and/or of charging and/or of deformation and/or of heat treatment in a volume external to a first surface of revolution 21 about pivot axis D and resting on the minimum radius 201 of peripheral surface 20 and at a distance greater than a third distance E3 from any active point of balance spring 3 to prevent any modification of the features of balance spring 3 during the irreversible re-machining of balance 2 on peripheral surface 20 to set the inertia of and/or to poise balance 2.

In a particular implementation of this method, there is selected a first surface 21 which forms, with pivot axis D, in a cross-section through pivot axis D, an angle β smaller than a predetermined value β0.

In a particular implementation of this method, balance 2 is provided with at least two housings 28, each arranged for receiving an adjustment screw 9, mounted captive on either side of the peripheral section 29 of balance 2, and wherein screw 9 is only moveable between first stop position 91 on balance 2 on which a first head 93 of screw 9 is held pressed during the factory setting, when the irreversible machining of balance 2 is performed, and a second stop position 92 defining an end of travel of a second head 94 of screw 9, the distance between the first stop position 91 and the second stop position 92 limiting the adjusting power of screw 9, which is limited to 30 seconds per day for after-sales purposes.

In a particular implementation of this method, prior to being secured to balance 2, balance spring 3 is pre-heat treated so as to resist localised heating in a nearby area when balance 2 is re-machined on peripheral surface 20 to set the inertia of and/or poise balance 2.

In a particular implementation of this method, balance cock 80 is made with an open shape and includes at least one recess 81 through which there is circulated a suction flow created in mechanism 10 when balance 2 is re-machined on peripheral area 20 to set the inertia of and/or poise balance 2 in the assembled assembly 1.

In a particular implementation of this method, plate 8 is made with at least one hole 82 for facilitating a suction flow created in mechanism 10 during re-machining of balance 2 on peripheral surface 20 to set the inertia of and/or poise balance 2 on the assembled assembly 1, and this sprung balance assembly 1 is subjected, during the inertia setting and/or poising re-machining operations, to a suction flow channelled through orifices 81 and/or recesses 81 in plate 8 and balance cock 80 between which this sprung balance assembly 1 is mounted.

In a particular implementation of this method, after the irreversible inertia setting and/or poising machining operation during factory setting, oscillator mechanism 10 is adjusted in the after-sales service using adjustment screws 9 of balance 2 as the only means of adjustment.

In a particular implementation of this method, a volume is delimited for the envelope of action of the re-machining means, at least beyond a first surface 21, as defined above, and on the opposite side of balance spring 3 relative to said first surface 21. Further, the re-machining means is oriented, namely, depending on the case, the axes of the laser or plasma beams or machining spindles, in directions such that the heat effects or chips or dust created do not come within range of the balance spring. Preferably, these axes are oriented in the angular sector w, having a value equal to angle β, as seen in FIG. 3, so that the reflection of rays, flow, chips and dust occurs away from balance spring 3.

The invention is well suited, in particular, to re-machining for inertia setting and/or poising in an assembled movement 10. The definition of a second security surface envelope 22, as explained above, protects the other components of the movement, and it must then be ensured that the reflection of any flow and waste remains within the two surfaces 21 and 22. The presence of a suction flow oriented in an appropriate manner, in particular, rising from S2 to S2 in the example of FIG. 3, further improves this security, and ensures that movement 10 remains clean after the re-machining operation.

After the last operating adjustment formed by this re-machining operation to set the inertia of and/or poise the balance, movement 10 does not undergo any further factory setting. If the balance is provided with adjustment screws 9, as set out above, the after-sales service has a limited range of adjustment.

A return to the factory thus requires the inertia to be reset, in a similar operation to that described here, the advantage of the invention being that it is unnecessary to dismantle the movement to perform this operation.

The invention prevents any modification of the balance spring during re-machining of the balance. An additional effect is that it is easier to perform the irreversible poising machining operation, owing to particular geometrical features. A particular solution is provided to the recurrent problem of identifying counterfeits with the alternative use of a balance made of two materials, or having an inner treated area to prevent re-machining.

The invention claimed is:

1. A method for producing and for setting inertia of and/or for poising a sprung balance assembly mounted in a timepiece oscillator mechanism which includes, mounted on a plate carrying a balance spring stud via a balance cock, the sprung balance assembly including a balance pivoting about a pivot axis and a balance spring whose inner coil is fixed to the balance or to a collet mounted integrally with the balance and whose outer coil is fixed to the stud to be held in the plate or in the balance cock, the method comprising:

selecting a re-machining technology for setting the inertia of and/or for poising the balance by removal of material, from among tool or abrasive machining or laser beam or plasma projection or liquid jet projection, the re-machining technology being implemented by a re-machining means including a means of ablation and/or of charging and/or of deformation and/or of heat treatment;

defining, according to the selection of the re-machining technology, a value of a first distance, forming a minimum distance between any point of the balance spring and a re-machining area for setting the inertia of and/or for poising the balance;

determining a peripheral surface for setting the inertia of and/or for poising the balance, at a periphery of the balance, as a re-machining area, any point of the surface being separated from the balance spring by at least the value of the first predefined distance, to prevent any modification of features of the balance spring during irreversible re-machining of the balance on the peripheral area for setting the inertia of and/or for poising the balance on the assembled sprung-balance assembly;

making the balance spring, prior to attachment to the balance, with the outer coil thereof bent and/or twisted on the attachment thereof to the balance spring stud to move an active end part of the outer coil away from the peripheral surface;

manufacturing the balance and the balance spring, and irreversibly assembling to each other by fixing the inner coil to the balance or to the collet mounted integrally with the balance;

fixing the outer coil in position to the balance spring stud which is immobilized by irreversible attachment with respect to the balance cock;

defining, according to the selected re-machining technology, a value of a second distance, greater than or equal to the first distance and forming the minimum distance between the balance spring stud and the peripheral surface separated from the balance spring stud by a value greater than a second predefined distance, to prevent any modification of features of the attachment of the balance spring to the balance spring stud during re-machining of the balance on the peripheral area for setting the inertia of and/or for poising the balance on the assembled sprung-balance assembly;

determining a value and location of any necessary re-machining operations for setting the inertia and/or for poising;

determining a limit of a trajectory of the re-machining means, the limit being a volume external to a first surface of revolution about the pivot axis and resting on a minimum radius of the peripheral surface and at a third distance from any active point of the balance spring, the determining including comparing the third distance to the first distance to ensure that the third distance is equal to or greater than the first distance, and the first surface is a cone with a first apex centered on the pivot axis and whose first apex angle is lower than a first predetermined value; and performing the inertia setting and/or poising re-machining operations only on the peripheral surface according to the limit of the trajectory of the re-machining means.

2. The method according to claim 1, wherein, when the inertia setting and/or poising re-machining is performed only on the peripheral surface, the trajectory of the re-machining means is limited to an internal volume to a second surface resting on the maximum radius of the peripheral surface and defining a protective envelope for the oscillator mechanism and a protective envelope for the balance spring against a direct or indirect projection of any chip or other waste, the second surface being a cone with a second apex centered on the pivot axis and whose second apex angle is lower than a predetermined second value.

3. The method according to claim 2, wherein the second predetermined value is 45°.

4. The method according to claim 1, wherein, during the pre-manufacture of the balance, any area of the balance located beyond the peripheral surface and whose distance relative to the pivot axis is less than the minimum radius of the peripheral surface is made with at least the surface thereof including a heat treatment and/or a surface treatment conferring thereon greater resistance than the resistance of the peripheral surface to machining with a tool, or by abrasion, or by laser, and/or the area is made of a material more resistant than the peripheral surface to machining with a tool, or by abrasion, or by laser.

5. The method according to claim 4, wherein the at least one area is made with a surface cementation or nitriding treatment.

6. The method according to claim 4, wherein at least one area is made with a surface metallizing treatment to render the surface reflective to laser beams in usual wavelengths used for machining lasers.

7. The method according to claim 1, wherein the first apex of the first surface is on a same side as the balance spring with respect to the balance.

8. The method according to claim 1, wherein the second apex is on an opposite side to the balance spring with respect to the balance.

9. The method according to claim 1, wherein the first surface and the second surface together define, in a cross-section through the pivot axis, a third angle lower than a predetermined value less than 45°.

10. The method according to claim 1, wherein the plate and/or the balance cock are made to allow access of the re-machining means to the peripheral surface.

11. The method according to claim 1, wherein, when the re-machining operation is performed to set the inertia of or to poise the sprung balance assembly, the balance is machined with furrows having a depth greater than one times the width thereof.

12. The method according to claim 1, wherein, prior to being secured to the balance, the balance spring is made of silicon, or silicon oxide, or single crystal diamond, or polycrystalline diamond, or glass, or metallic glass, or amorphous metal, or quartz, or a paramagnetic material, or ferromagnetic material, or an anti-ferromagnetic material.

13. The method according to claim 1, wherein the third distance is between 100% and 120% of the first distance.

14. The method according to claim 1, wherein the third distance is equal to the first distance.

15. The method according to claim 1, wherein the making the balance spring includes twisting the outer coil of the balance spring such that a twisted portion of the outer coil faces along the pivot axis, the active end part of the outer coil facing radially toward and away from the pivot axis.

* * * * *